US005813272A

United States Patent [19]

Gomi

[11] Patent Number: 5,813,272

[45] Date of Patent: Sep. 29, 1998

[54] APPARATUS FOR FULL ENCLOSED DIE FORGING

[75] Inventor: Kazuhiko Gomi, Hirakata, Japan

[73] Assignee: Kabushiki Kaisha Sakamura Kikai Seisakusho, Osaka, Japan

[21] Appl. No.: 854,100

[22] Filed: May 9, 1997

[30] Foreign Application Priority Data

May 9, 1996 [JP] Japan ..... 8-140784

[51] Int. Cl.[6] ..... B21J 13/02

[52] U.S. Cl. ..... 72/354.8; 72/357

[58] Field of Search ..... 72/354.6, 354.8, 72/355.2, 355.6, 357

[56] References Cited

U.S. PATENT DOCUMENTS

| | | | |
|---|---|---|---|
| 2,826,161 | 3/1958 | Palmer | 72/354.2 |
| 3,459,021 | 8/1969 | Fuchs, Jr. | 72/347 |

FOREIGN PATENT DOCUMENTS

| | | | |
|---|---|---|---|
| 47616 | 10/1987 | Japan . | |
| 133135 | 5/1990 | Japan | 72/355.6 |
| 184647 | 8/1991 | Japan . | |
| 126371 | 5/1994 | Japan . | |
| 274619 | 6/1970 | U.S.S.R. | 72/354.6 |

OTHER PUBLICATIONS

"Forging Technology" 30 Aug. 1995, Corona Publishing Co., Ltd., Tokyo, Japan, pp. 139–143.

*Primary Examiner*—Lowell A. Larson
*Attorney, Agent, or Firm*—Barnes & Thornburg

[57] ABSTRACT

The invention provides an apparatus for full enclosed die forging having a stationary die, a movable die toward and away from the stationary die and punches which plunge into a work in the closed dies to form tools. After the stationary die in the die housing and the movable die on the ram are closed, the closed pair of dies is moved in a forging direction into the inside of the die housing. In the die housing is equipped an annular engaging member which is movable in the forging direction and shrinkable toward the closed pair of dies in the die housing. The annular engaging member is thrusted into the inside of the die housing along with the closed pair of dies by thrusting means. Shrinking means is provided for shrinking the annular engaging member toward the closed pair of dies in the die housing as the annular engaging member is thrusted into the die housing so that the annular engaging member engages with the closed pair of dies and clamp them tightly.

8 Claims, 14 Drawing Sheets

APPARATUS FOR FULL ENCLOSED DIE FORGING

FIELD OF THE INVENTION

The present invention relates to a forging apparatus, and more particularly to an apparatus for full enclosed die forging which hardly gives birth to flash on products.

BACKGROUND OF THE INVENTION

In connection with an apparatus with a full enclosed die forging system to form tools like gears, which is provided with a pair of dies, a stationary die and a movable die toward and away from the stationary die, and punches to plunge into a cavity shaped inside of the closed pair of dies, a weak die closing force allows material of a workpiece to be forged in the cavity to flow out therefrom through a gap between the mating die faces when the punches come into the cavity, and it causes flash on a product.

Heretofore, to avoid the forming of flash, in Japanese Unexamined Patent Publication No. 184647/91, it is disclosed that springs are provided to force the movable die onto the stationary die during the forging operation so as to ensure a tight closing of the dies. However, a biasing force generated by the springs are not so strong enough to maintain the tight closing of the dies, especially when a degree of transformation of the workpiece is higher, thus, a mass of the material of the workpiece to flow in the cavity and an internal pressure in the closed pair of dies are also higher.

On the other hand, it is known that a hydraulic pressure is utilized to close the pair of dies tightly so as to prevent the material of the workpiece inside them leaking out. But, in this case, to utilize the hydraulic pressure requires a hydraulic system and other regulating systems which complicate a structure and an operation of the forging apparatus.

SUMMARY OF THE INVENTION

Consequently, it is an object of the present invention to provide an apparatus for full enclosed die forging, which is able to realize a tight closing of the dies during the forging operation to avoid the forming of flash on the product effectively by a simplified manner.

According to the invention, the stationary die equipped in a die housing on a die bank is withdrawn into an inside of the die housing in a forging direction after this stationary die and the movable die are closed due to a forward forging stroke of a ram to which is fixed the movable die.

An annular engaging element surrounds the stationary die, in the die housing. The annular engaging element is movable in the forging direction and shrinkable inwards with respect to the die housing, i.e., shrinkable toward the stationary die, or the pair of dies after this stationary die and the movable die are closed. When the closed pair of dies are withdrawn in the forging direction into the die housing, the annular element is also thrusted in the forging direction into the die housing simultaneously.

As the annular engaging element is thrusted in the forging direction into the die housing, it begins to be forced inwards relative to the die housing to shrink toward the closed pair of dies automatically. Preferably, this is by partial conversion of the moving motion thereof along with the forging direction into a shrinking motion in a direction transverse perpendicular to the direction of the moving motion. The annular engaging element shrinks finally to reach the closed pair of dies and engages both of the closed dies. Subsequently, the annular engaging element continues in the moving direction without shrinking motion.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
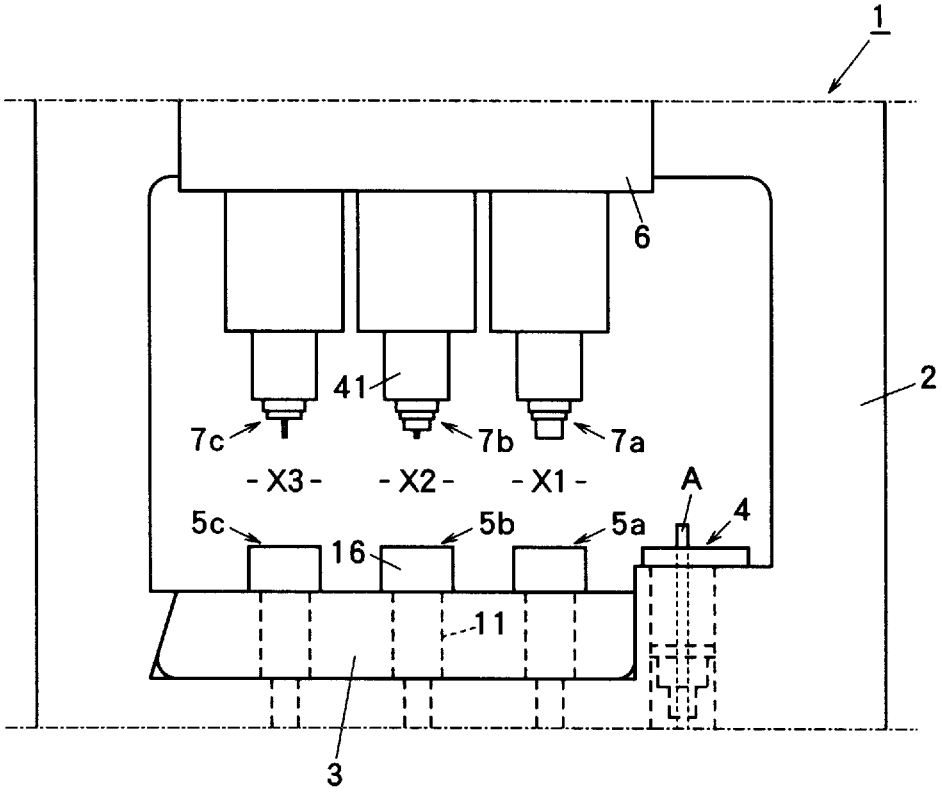
FIG. 1 is a schematic plan view of a forging apparatus according to an embodiment of the invention.

Referring to the drawings, as shown in FIG. 1, the invention is embodied in a multi-stage forging apparatus 1 having three working stations X1, X2 and X3 to fabricate bevel gears therethrough. The forging apparatus 1 comprises a frame 2 to which are fixed a cutting unit 4 and a die bank 3 provided with three stationary die units 5*a*, 5*b* and 5*c* aligned horizontally to leave suitable intervals therebetween. The forging apparatus 1 further comprises a ram 6 which reciprocates horizontally toward and away from the die bank 3, and on the ram 6 are mounted three movable die units 7*a*, 7*b* and 7*c* corresponding to the stationary die units 5*a*, 5*b* and 5*c* of the die bank 3 to define the three working stations X1, X2 and X3, respectively.

Figure 2:
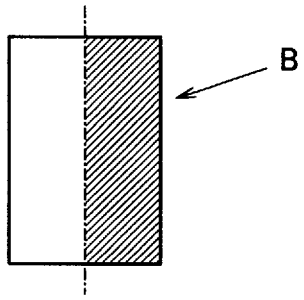
FIG. 2 to 5 are half cross-sectional views showing a successive transformation of a workpiece forged by the apparatus.
Figure 3:
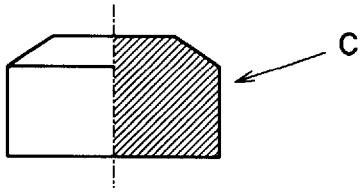
Figure 4:
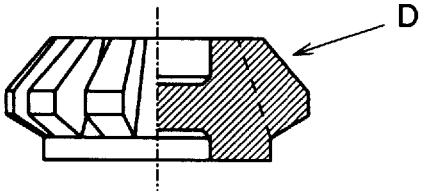
Figure 5:
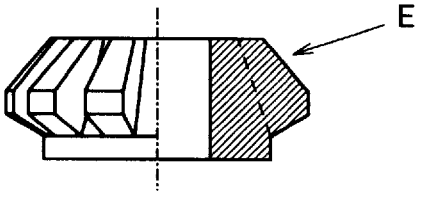

The cutting unit 4 cuts a rod designated as reference character "A", which is fed as a raw material to the apparatus 1 by a suitable feeding device (not shown), into a workpiece B of a desired length as shown in FIG. 2, and the workpiece B is transferred throughout the working stations X1, X2 and X3 successively with the aid of automatic transfer (not shown). The first station X1 is a preforging station to form a flattened cylindrical intermediate workpiece C as shown in FIG. 3. The second station X2 is a full enclosed die forging station, which provides the subject matter of the invention, to form an intermediate workpiece D almost a finish product as shown in FIG. 4. The last station X3 is a piercing station to form a finish product E, a bevel gear, as shown in FIG. 5.

Figure 6:
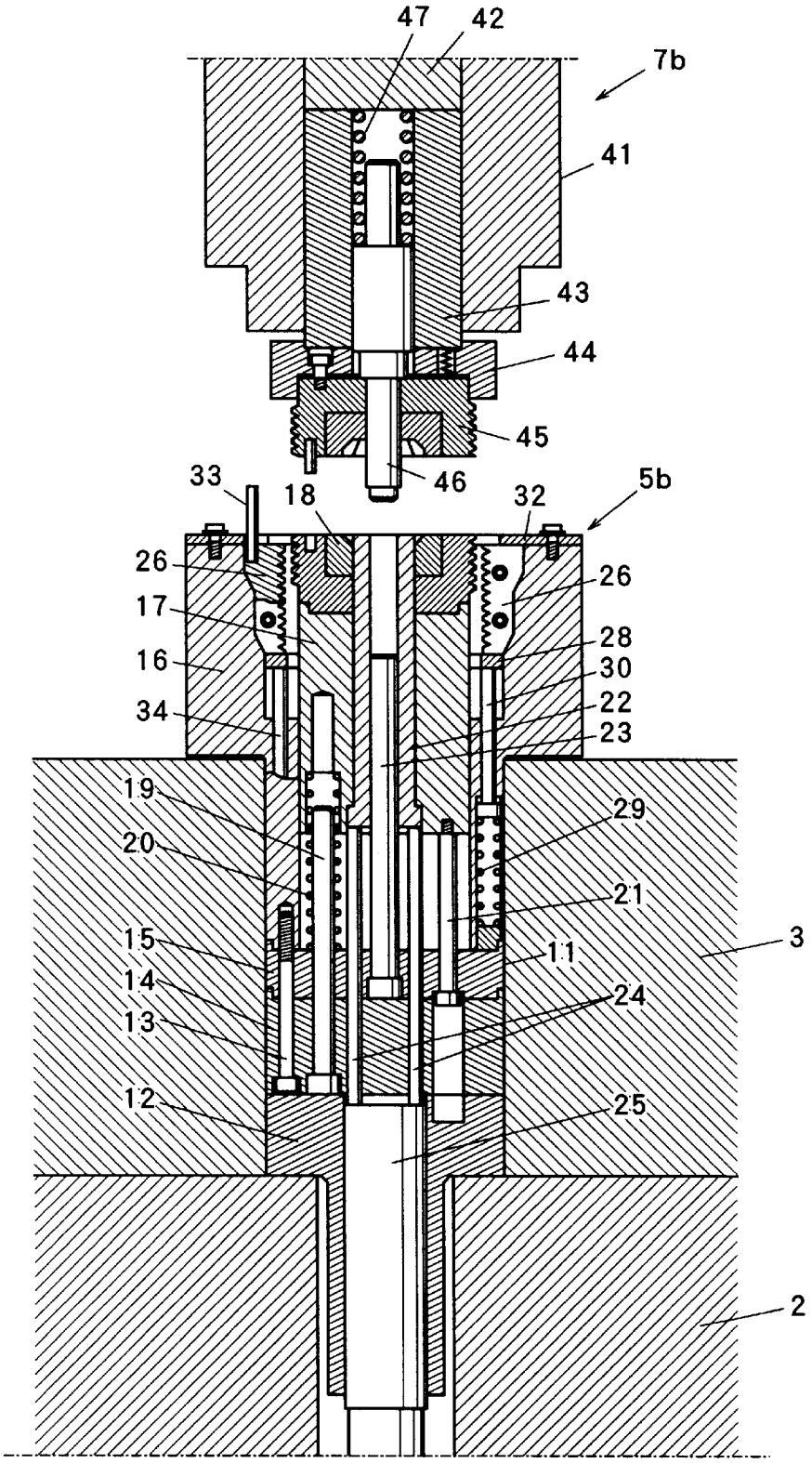
FIG. 6 is a cross-sectional plan view showing a structure of the second working station of the apparatus.

A structure of the pair of die units 5*b*, 7*b* cooperating therewith to define the full enclosed die forging station X2 will be further described in detail, which is as follows:

As shown in FIGS. 1 and 6, at a position of the stationary die unit 5*b* the die bank 3 has a mounting hole 11 whose longitudinal axis extends in a direction of reciprocating motion of the ram 6, i.e., a forging direction. The die bank 3 accommodates in the hall 11 a pressure receive member 12 adjacent to the frame 2 and a rear portion of the stationary die unit 5*b* adjacent to the pressure receive member 12. The die unit 5*b* includes a pair of support members 14, 15 in the hall 11 and a die housing 16 whose rear portion is in the hall 11 and enlarged cylindrical front portion is placed on a front face of the die bank 3. The support members 14, 15 and the die housing 16 are connected together by bolt 13.

The die housing 16 accommodates in its interior slidably in the forging direction a retainer 17 onto a front end of which a stationary die 18 is attached. The retainer 17 is biased forwards, i.e., in a direction of the ram 6, by means of spring 20 supported by pin 19 extending forwards from the support member 15. The retainer 17 stops in its foremost position relative to the die housing 16 as shown in FIG. 6 owing to contact of head of bolt 21 extending backwards from a rear end thereof with a rear face of the support member 15.

In centers of the retainer 17 and the die 18 is installed slidably in the forging direction a sleeve 22 having a length between a rear end of the retainer 17 and a die face of the die 18. Through the sleeve 22 passes a punch 23 which is fixed to the pair of support members 14, 15 at an enlarged rear end thereof and extending forwards coaxially with respect to the sleeve 22, the retainer 17 and the die 18. Thus, the sleeve 22 and the retainer 17 with the die 18 are independently slidable in the forging direction relative to the punch 23 and the die housing 16.

Through the support members 14, 15 are passing plural eject pins 24 . . . 24 whose front ends bear the sleeve 22 and rear ends are adjacent to a knockout pin 25 installed slidably in the pressure receive member 12.

Figure 7:
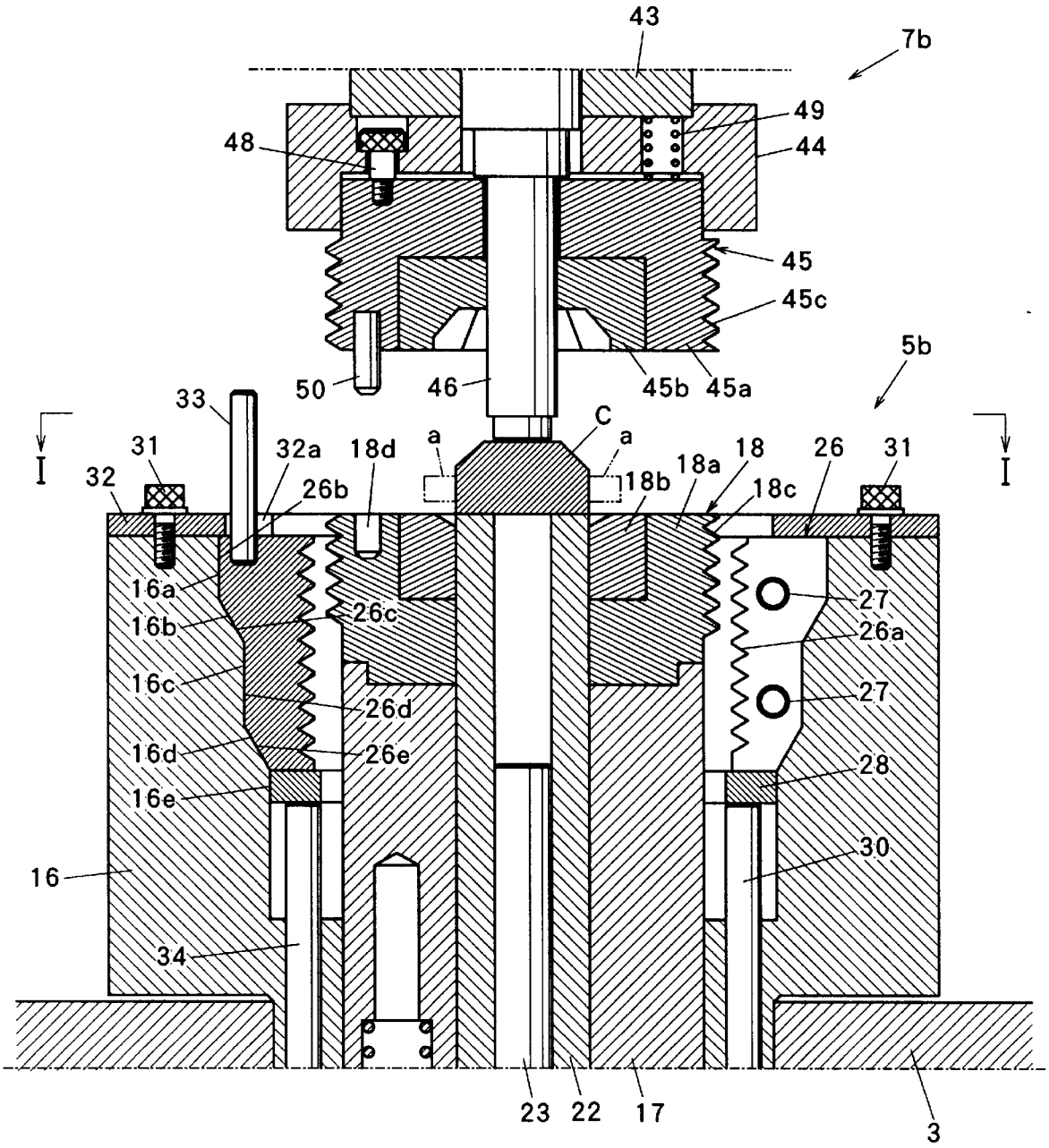
FIG. 7 is an enlarged cross-sectional plan view showing a structure of a stationary die unit and a movable die unit of the second working station.
Figure 8:
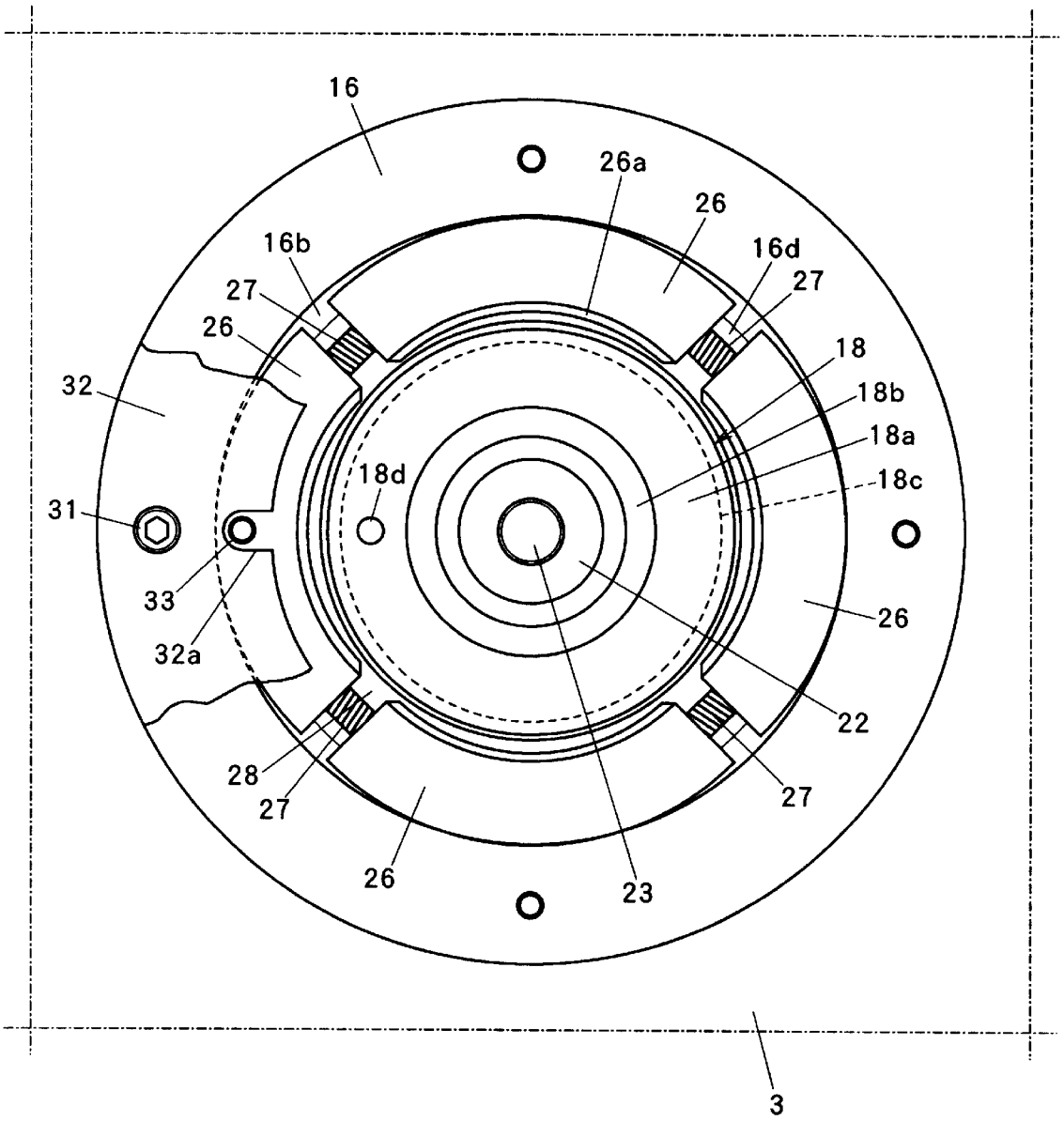
FIG. 8 is an elevational view of the stationary die unit of the second working station taken in the direction of the arrows I—I in FIG. 7.

As shown in FIGS. 7 and 8, the stationary die 18 consists of a mother die 18*a* and an insert die 18*b* embedded in a die face of the mother die 18*a*, on a peripheral face of which is formed external thread 18*c*, and the die 18 is surrounded by four engaging members 26 . . . 26 equipped in the enlarged cylindrical front portion of the die housing 16.

Each of the engaging member 26 is like a longitudinally quartered piece of a tubular member. On an inner surface of the engaging matter 26 is formed internal thread 26*a* capable for engaging with the external thread 18*c* of the die 18. On a convexly curved outer surface of each member 26 is formed a stepped surface with a first large diametral face 26*b*, a first tapered face 26*c* inclined inwards as backwards with respect to the die housing 16, a second small diametral face 26*d* and a second tapered face 26*e* having the same character as the first tapered face 26*c* in order from the front. On a correspondently concavely curved inner surface of the front portion of the die housing 16, where the four engaging members 26 . . . 26 are equipped, is also formed a stepped surface with a first large diametral face 16*a*, a first tapered face 16*b* inclined inwards as backwards with respect to the die housing 16, a second small diametral face 16*c*, a second tapered face 16*d* having the same character as the first tapered face 16*b* and a third smaller diametral face 16*e* in order from the front.

Each member 26 is connected to adjacent members 26, 26 by means of springs 27 . . . 27 to form an annular quaternion thereof. The springs 27 . . . 27 bias the four members 26 . . . 26 so as to increase a diameter of the annular quaternion. The engaging members 26 . . . 26 are supported by a ring member 28 installed slidably along the third smaller diametral face 16*e*. The ring member 28 is borne by push pins 30 . . . 30 which are biased forwards by means of springs 29 . . . 29 (see FIG. 6) provided in the rear portion of the die housing 16. Thus, the quaternion is also biased forwards by means of the springs 29 . . . 29, but it stops in its foremost position relative to the die housing 16 as shown in FIG. 7 owing to contact of front ends of the engaging members 26 . . . 26 with a ring-shaped stopper 32 fixed on a front face of the die housing 16 by bolts 31 . . . 31.

Consequently, the engaging members 26 . . . 26 are equipped in the front portion of the die housing 16 in such manner that when the quaternion is in its foremost position in the die housing 16 owing to the biasing force of the springs 29 . . . 29, the first large diametral faces 26*b* . . . 26*b*, the first tapered faces 26*c* . . . 26*c*, the second small diametral faces 26*d* . . . 26*d* and the second tapered faces 26*e* . . . 26*e* of the engaging members 26 . . . 26 are in contact with the first large diametral face 16*a*, the first tapered face 16*b*, the second small diametral face 16*c* and the second tapered face 16*d* of the housing 16, respectively, due to the biasing force of the springs 27 . . . 27 which push the four members 26 . . . 26 outwards with respect to the die housing 16. When the quaternion is forced backwards against the biasing force of the springs 29 . . . 29, the four engaging members 26 . . . 26 come close relative to each other inwards with respect to the die housing 16 against the biasing force of the springs 27 . . . 27 under cooperative guidance of the tapered faces 16*b*, 26*c* . . . 26*c* and 16*d*, 26*e* . . . 26*e*, and the diameter of the quaternion will decrease.

Rotation of the engaging members 26 . . . 26 with respect to the die housing 16 and the stationary die 18 about the axis of the forging direction is prohibited by arresting a small pin 33 extending forwards from a front end of one of the engaging members 26 . . . 26 in a cut-out 32*a* formed in the stopper 32.

In addition to the above-mentioned push pins 30 . . . 30 which bear the ring member 28 and are biased forwards by the springs 29 . . . 29, in the rear portion of the die housing 16, as shown in FIG. 6, are equipped another type of pins 34 . . . 34 which also bear the ring member 28 and are biased forwards by springs (not shown). These pins 34 . . . 34 are far longer than the push pins 30 . . . 30, rear ends reaching close to the die bank 3, and are driven by a driver (not shown) mounted on the die bank 3 so as to flip the ring member 28 forwards and to give an impact to the engaging members 26 . . . 26 supported by the ring member 28. These flip pins 34 . . . 34 and push pins 30 . . . 30 are aligned in the die housing 16 about the extending axis thereof alternately by 60 degrees.

On the other hand, as shown in FIGS. 1 and 6, at a position of the movable die unit 7*b* the ram 6 has a hollow holder 41 whose longitudinal axis extends in the forging direction. The holder 41 accommodates in its interior a pressure receive member 42 and a support member 43 adjacent to the pressure receive member 42. The movable die unit 7*b* includes the support member 43 in the holder 41, a spacer 44 attached to a front end of the support member 43 by bolts (not shown), a die 45 disposed in a front face of the spacer 44 and a punch 46 passing through these members 43, 44, and 45 at their centers in the forging direction. The punch 46 is biased forwards, i.e., in a direction of the die bank 3, by means of a spring 47 equipped in the holder 41 so as to project its front end from a die face of the movable die 45 by predetermined length.

As shown in FIG. 7, the movable die 45 consists of a mother die 45*a* and an insert die 45*b* embedded in a die face of the mother die 45*a*, on a peripheral face of which is formed external thread 45*c*. The die 45 is connected to the spacer 44 by a bolt 48 loosely to move to some extent and biased forwards by means of spring 49 equipped in the spacer 44.

The mother die 45*a* is provided with a positioning pin 50 extending from the die face thereof toward the mother die 18*a* of the stationary die 18. When the stationary die 18 and the movable die 45 are closed together, the pin 50 fits a hole 18*d* formed on the die face of the mother die 18*a* of the stationary die 18 so as to position the pair of dies 18, 45 properly, resulting in that the external threads 18*c* and 45*c* of the both dies 18 and 45 run coincidentally.

In the operation of the above described apparatus 1, as shown in FIG. 7, when the flattened intermediate workpiece C is transferred to the full enclosed die forging station X2 from the preforging station X1 by a chuck designated as reference character "a" of the unshown automatic transfer, the ram 6 begins to stroke forwards and the movable die unit 7*b* approaches to the stationary die unit 5*b*. Then the work C is held between the front end of the punch 46 of the movable die unit 7*b* and the front end of the sleeve 22 of the stationary die unit 5*b*.

Figure 9:
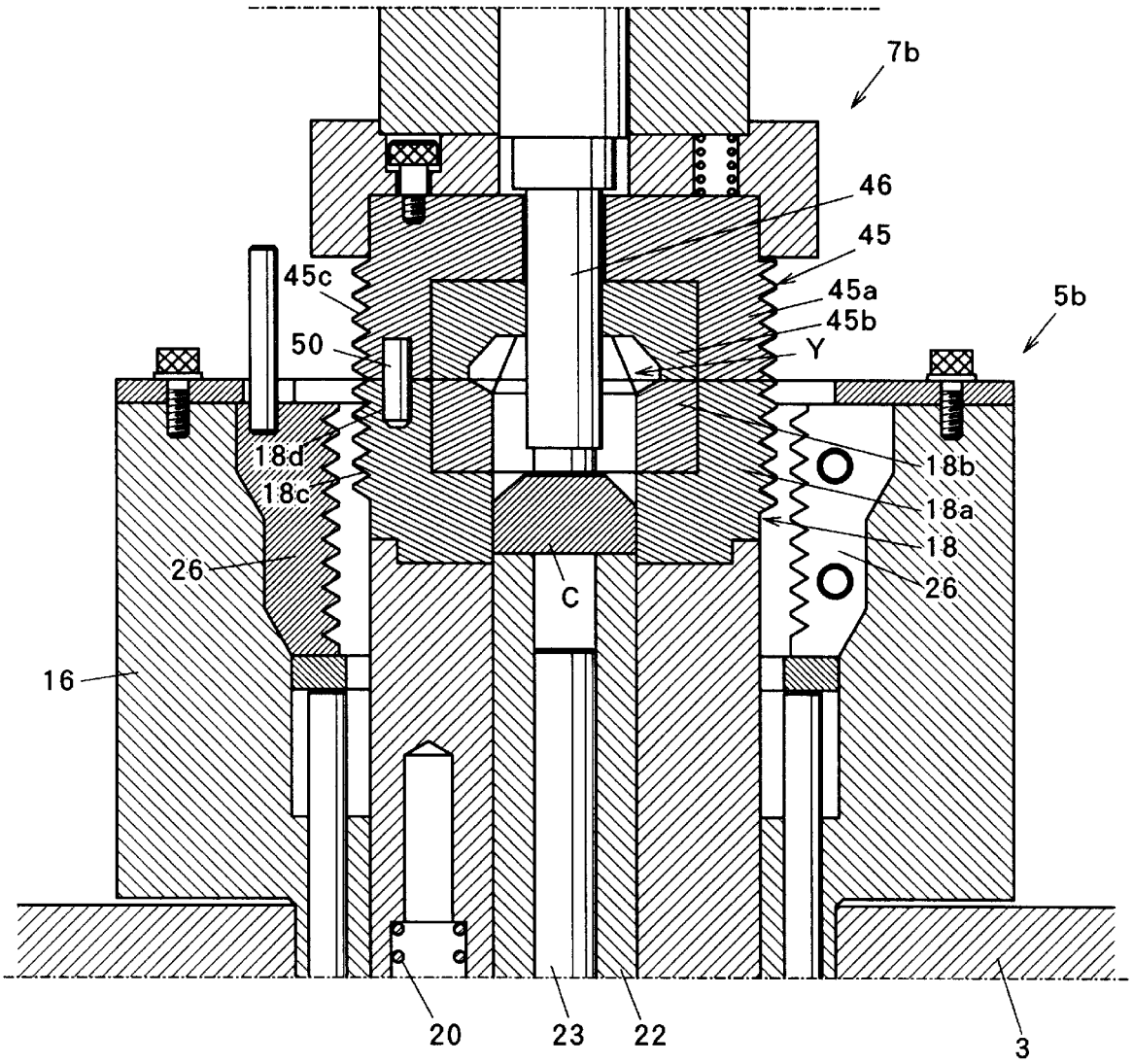
FIGS. 9 to 13 are enlarged cross-sectional plan views showing a forging operation of the second working station step by step.

As the ram 6 strokes forwards, as shown in FIG. 9, the punch 46 pushes the work C toward the die bank 3 and the sleeve 22 is thrusted backwards, i.e., into the inside of the die housing 16, and then, the work C is inserted in the retainer 17. The positioning pin 50 of the movable die 45 fits the hole 18*d* of the stationary die 18, and when the pair of dies 18, 45 mates together the external threads 18*c*, 45*c* thereof run coincidentally and a cavity Y corresponding to an outline of the finish product, bevel gear E, is shaped inside the closed dies 18, 45.

Figure 10:
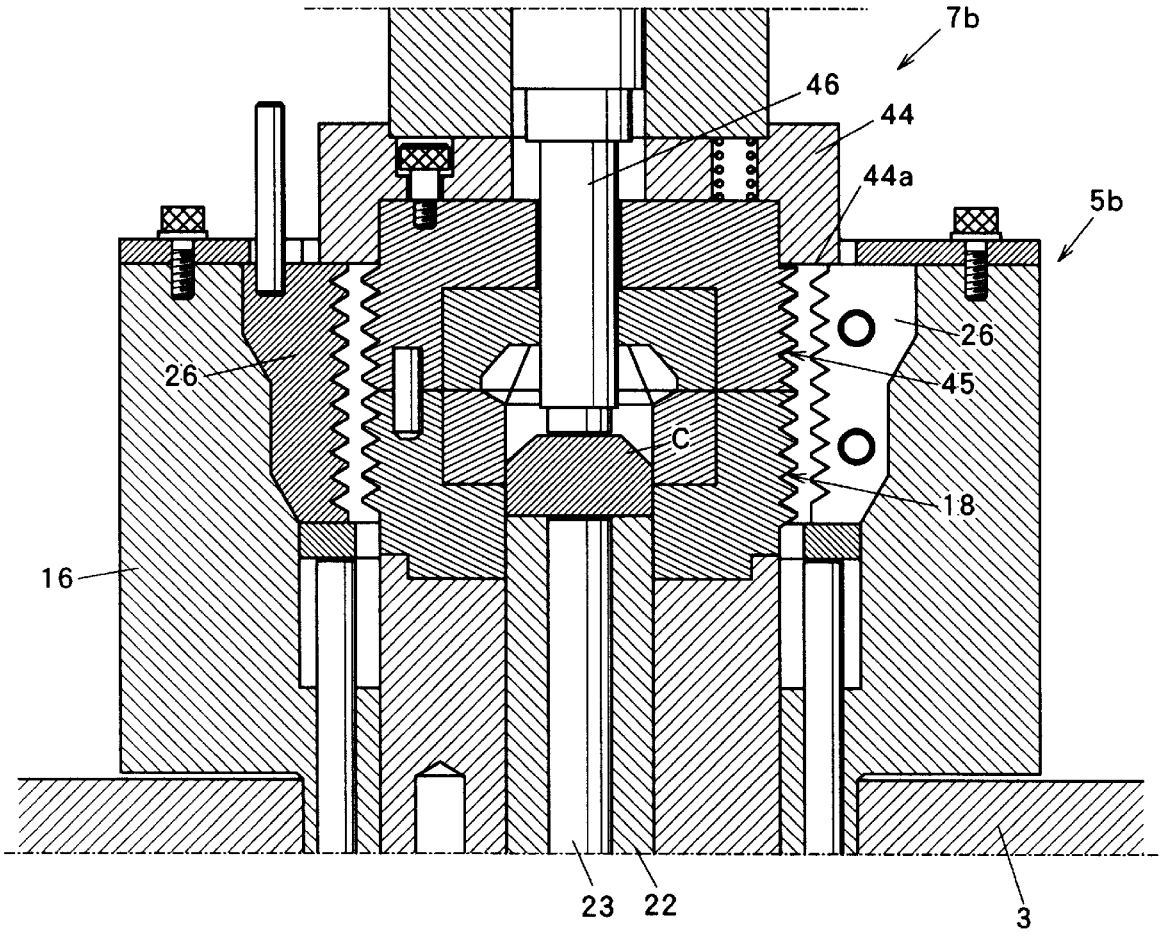

As the ram 6 strokes forwards further, as shown in FIG. 10, the closed pair of dies 18, 45 withdraws into the die housing 16 against the biasing force of the spring 20 (see FIG. 6), and then, the front end of the fixed punch 23 of the stationary die unit 5*b* hits a back of the work C. In addition, the front face 44*a* of the spacer 44 surrounding the die 45 abuts against the front faces of the four engaging members 26 . . . 26 equipped in the die housing 16.

Figure 11:
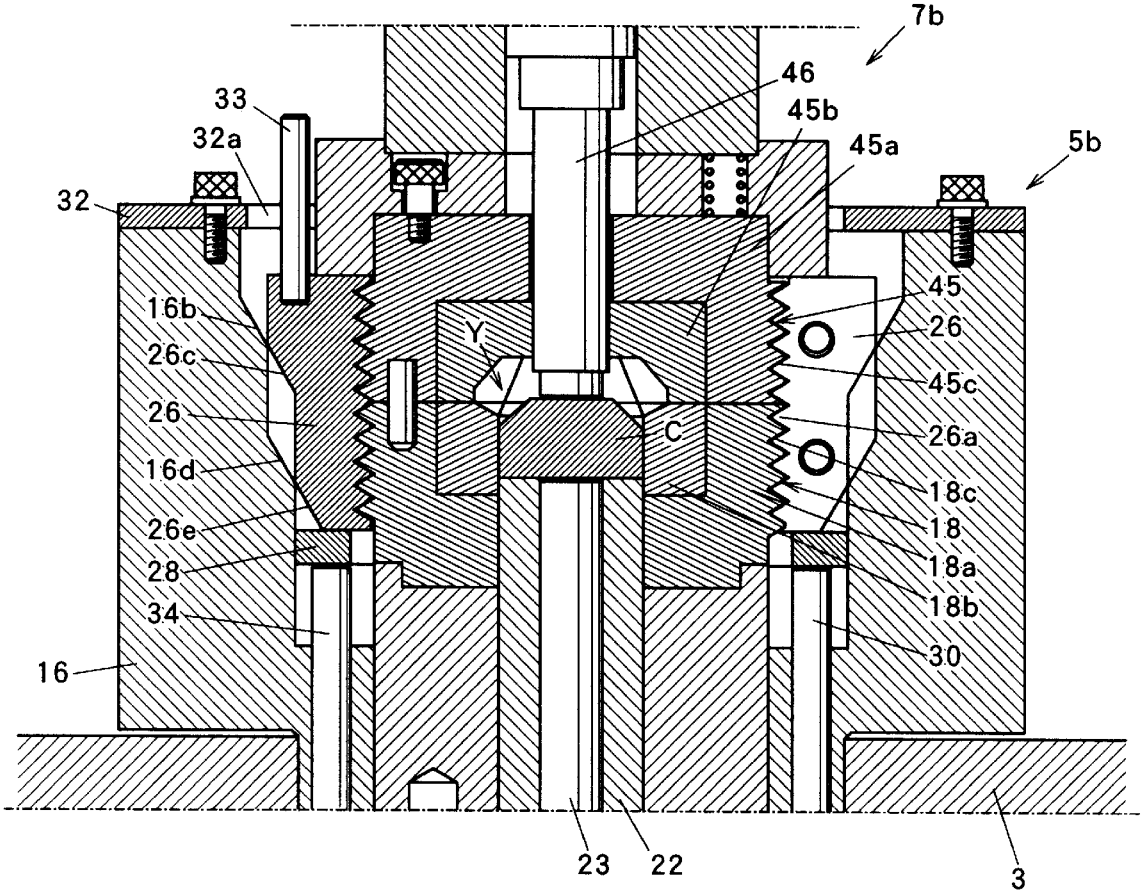

As the ram 6 strokes forwards still further, as shown in FIG. 11, the engaging members 26 . . . 26 are thrusted backwards by the spacer 44 into the inside of the die housing 16 against the biasing force of the springs 29 . . . 29 (see FIG. 6) as well as the closed pair of dies 18, 45 withdraws further. As the four engaging members 26 . . . 26 are thrusted backwards, they come close relative to each other inwards with respect to the die housing 16 against the biasing force of the springs 27 . . . 27 (see FIGS. 7 and 8) due to the cooperative guidance of the tapered faces 26*c* . . . 26*c*, 26*e* . . . 26*e* of the outer surface thereof and the tapered faces 16*b*, 16*d* of the inner surface of the die housing 16. This leads to the decrease of the diameter of the annular quaternion of the four engaging members 26 . . . 26 and the internal thread 26*a* formed on the inner surface of each member 26 engages with the coincidentally running external threads 18*c*, 45*c* of the closed pair of dies 18, 45 at its midportion where the die faces thereof mate each other. The internal thread 26*a* of the quaternion of the engaging members 26 . . . 26 is to always engage properly with the external threads 18*c*, 45*c* of the closed dies 18, 45 owing to the arrest of the pin 33 of the quaternion by the cut-out 32*a* of the stopper 32, which prevents the quaternion from rotating relative to the pair of dies 18, 45.

On the other hand, the workpiece C stops moving backwards at a time as shown in FIG. 10, supported by the fixed punch 23 from the rear. Consequently, the work C is pushed into the cavity Y, and the punch 46 of the movable die unit 7*b* withdraws relative to the cavity Y, pressing the spring 47 (see FIG. 6) as the ram 6 strokes forwards as shown in FIG. 11.

Figure 12:
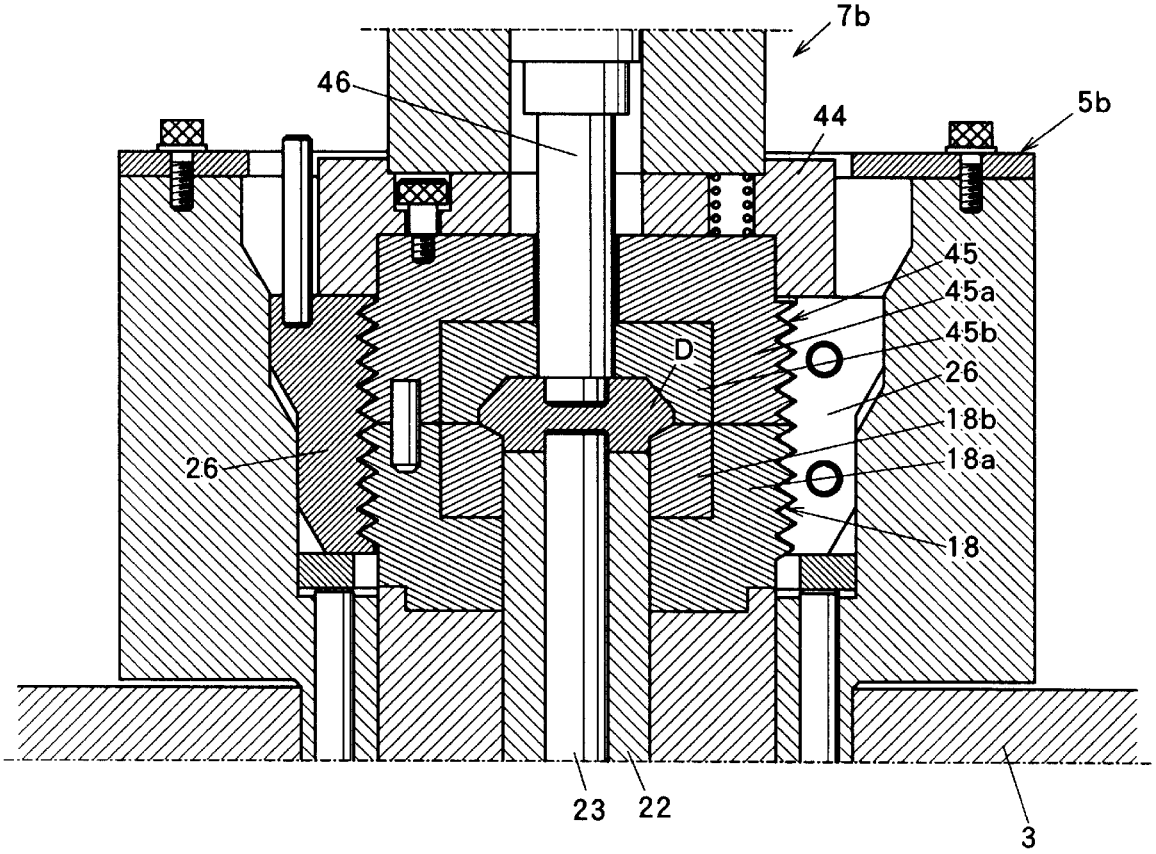

Then, as the ram 6 reaches to its forward stroke end, as shown in FIG. 12, the work C is wholly fed in the cavity Y, and the punch 46 of the movable die unit 7*b* returns to move forwards with respect to the die bank 3 because the rear end thereof abuts against the pressure receive member 42 in the holder 41 (see FIG. 6). Finally, the both front ends of the punches 23, 43 plunge into the work C in the cavity Y to form a recess on each face of the work C. This causes flow of material of the work C in the cavity Y to transform the work C into the next intermediate work D, as shown in FIG. 4, having teeth according to the shape of the cavity Y. During this period, an internal pressure in the cavity Y ascends due to the above-mentioned material flow of the work C, and arises a force which tends to part the closed pair of dies 18, 45. However, because the four engaging members 26 . . . 26 are engaged with the both dies 18, 45 by virtue of the threads 26*a* and 18*c*, 45*c*, the closed pair of dies 18, 45 are clamped tightly, and the material of the work C is prevented from leaking out from the cavity Y and the pair of dies 18, 45, and thus, formation of flash on the forged work D is avoided. In addition, because thread cutting technique is very common, the engaging members 26 . . . 26 having internal threads 26*a* and the pair of dies 18, 45 having external threads 18*c*, 45*c* of this embodiment can be easily prepared.

Figure 13:
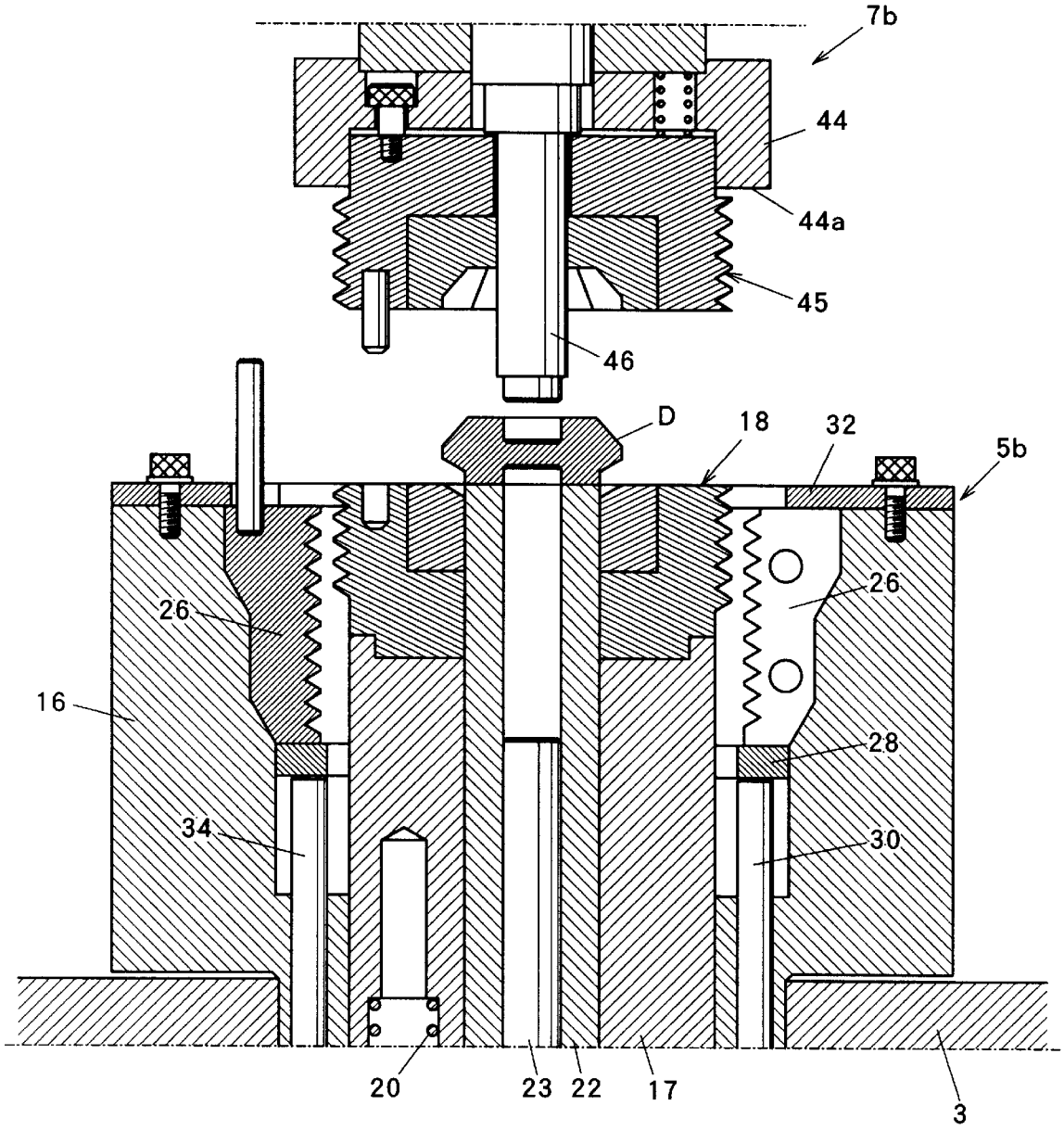

After the new intermediate work D is formed in the cavity Y, the ram 6 returns to stroke backwards and the movable die unit 7*b* withdraws relative to the stationary die unit 5*a* as shown in FIG. 13. As the die unit 7*b* withdraws, the retainer 17 with the stationary die 18 and the quaternion of the engaging members 26 . . . 26 are directed to their foremost positions owing to the biasing force of the springs 20 and 29 . . . 29, respectively, and the diameter of the quaternion returns to increase so that the stepped outer surfaces thereof contact with the stepped inner surface of the front portion of the housing 16. During the ram 6 strokes backwards, the knockout pin 25 is driven forwards by a driver (not shown) and the sleeve 22 is moved to push the intermediate work D out of the stationary die 18.

Besides, on return way of the four engaging members 26 . . . 26 to their foremost positions, when spacings are born between the stepped outer surfaces of the engaging members 26 . . . 26 and the stepped inner surfaces of the die housing 16, just at a time as shown in FIG. 11, the flip pins 34 . . . 34 are driven to flip the ring member 28 forwards so as to give an impact to the engaging members 26 . . . 26. This helps a release of the engaging members 26 . . . 26 from the closed pair of dies 18, 45, because the engaging members 26 26 have been squeezed onto the peripheral faces of the pair of dies 18, 45 during a period of forging stroke end, and the internal thread 26*a* of each member 26 and the external threads 18*c*, 45*c* of the closed pair of dies 18, 45 are likely to stick together.

Then, the intermediate workpiece D is transferred to the piercing station X3 by the transfer. There it is subjected to piercing operation which removes the center wall between the recesses of the intermediate work D, to form the finish product E, a bevel gear, as shown in FIG. 5.

Figure 14:
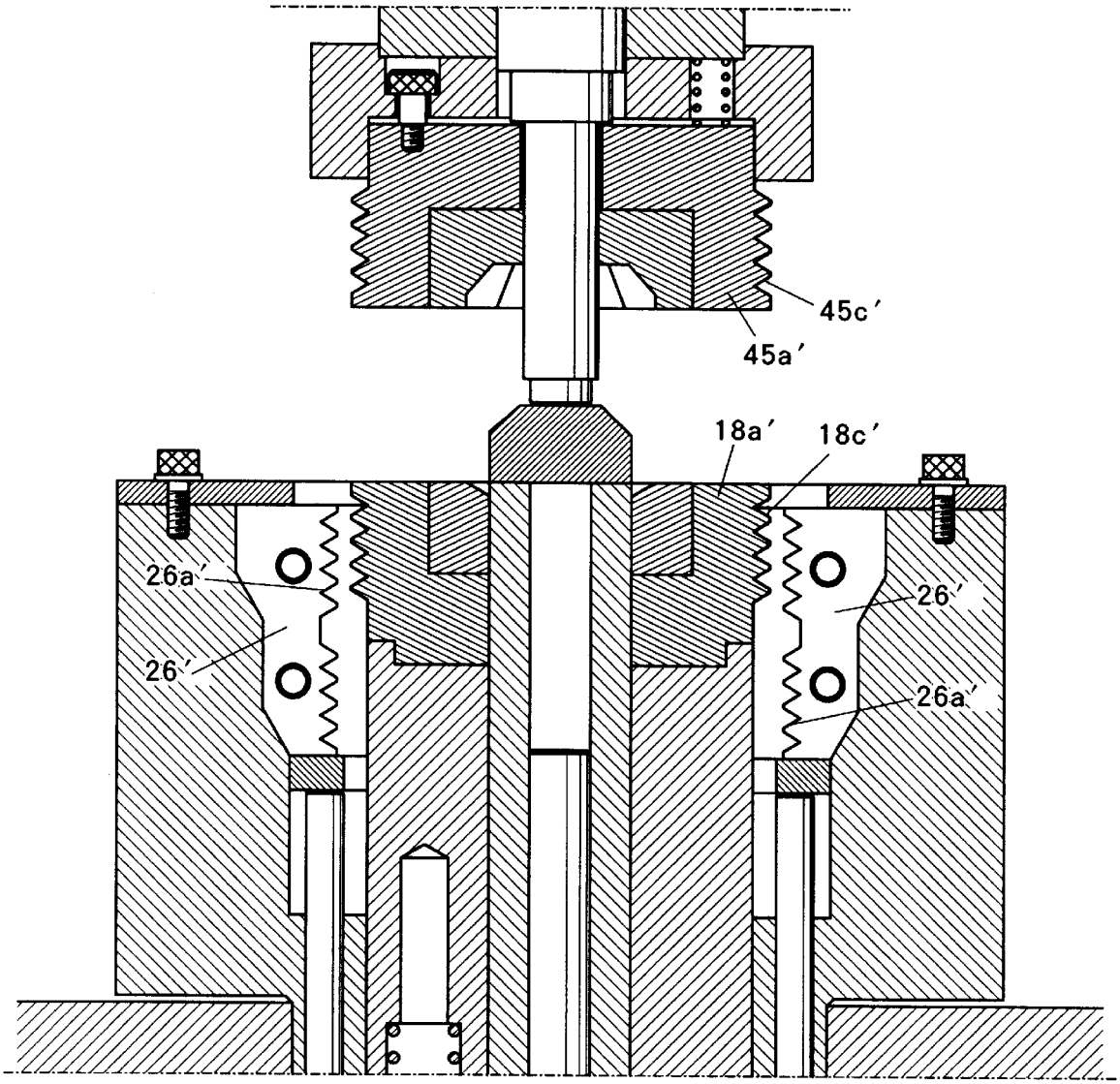
FIG. 14 is an enlarged cross-sectional plan view, similar to FIG. 7, showing the second embodiment of the invention.

In this embodiment, as mentioned above, the engaging members 26 . . . 26 and the pair of dies 18, 45 are provided with threads 26*a*, 18*c*, 45*c*, respectively so as to realize tight closing of the pair of dies 18, 45 during the forging operation. The second embodiment of the invention, as shown in FIG. 14, discloses another modification to achieve the same effects, in which a pair of mother dies 18*a*', 45*a*' are provided with plural grooves 18*c*', 45*c*' on peripheral faces thereof, substituted for the external threads 18*c*, 45*c*, and engaging members 26' . . . 26' with plural grooves 26*a*' . . . 26*a*' on inner surfaces thereof, capable for engaging with the grooves 18*c*', 45*c*' of the pair of mother dies 18*a*', 45*a*', substituted for the internal threads 26*a*. In this second embodiment, the rest of the forging apparatus are the same as those in the first embodiment.

Figure 15:
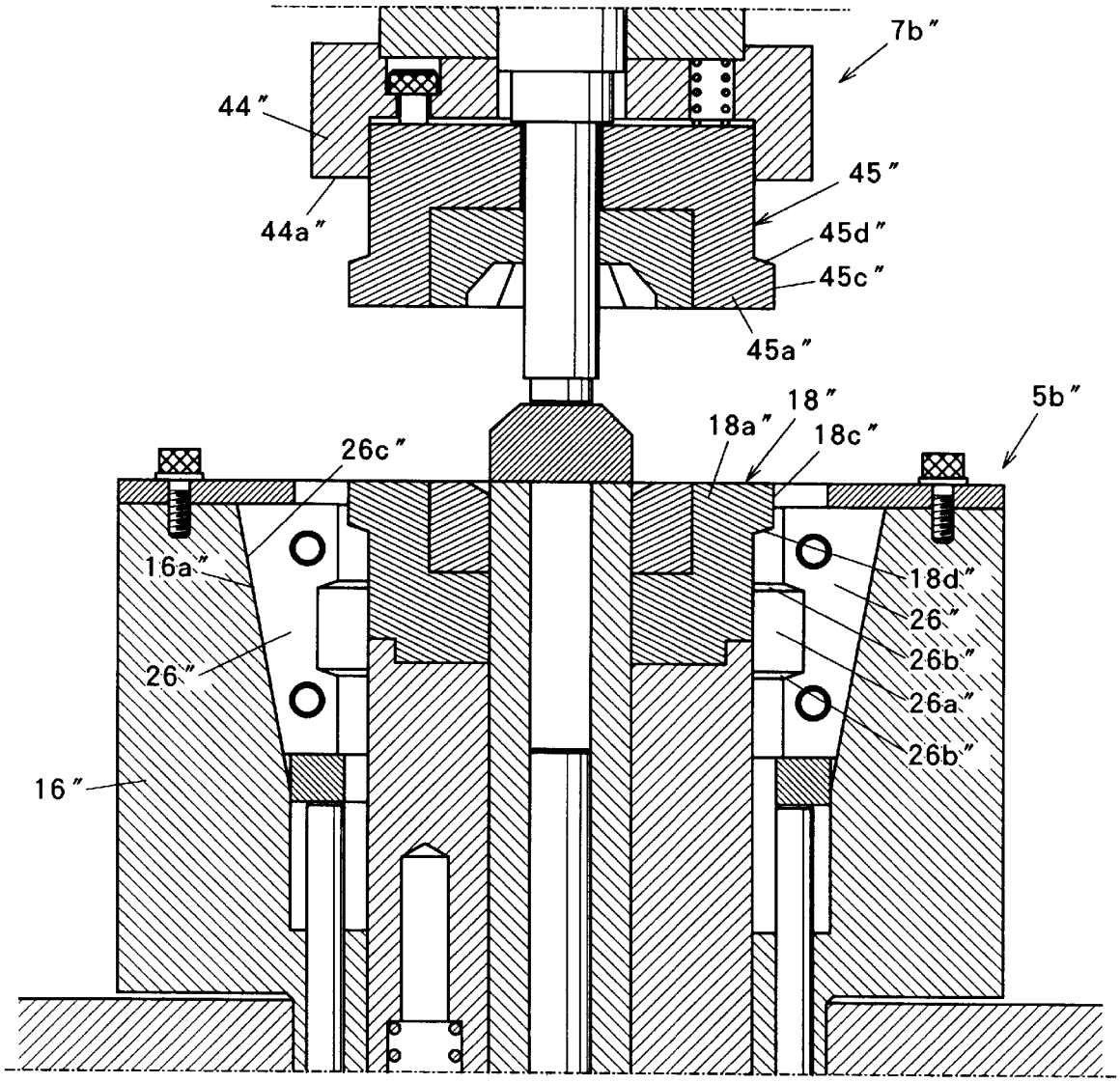
FIGS. 15 and 16 are enlarged cross-sectional plan views, similar to FIG. 7 and 12, respectively, showing the third embodiment of the invention.

FIG. 15 shows a still another embodiment of the invention, in which a pair of mother dies 18*a*", 45*a*" are provided with flanges 18*c*", 45*c*" on leading edges of peripheral faces thereof, instead of the external threads 18*c*, 45*c* or the plural grooves 18*c*', 45*c*'. Also, engaging members 26" . . . 26" are provided with recesses 26*a*" . . . 26*a*" on inner surfaces thereof, capable for clamping the flanges 18*c*", 45*c*" of the pair of dies 18", 45" at a time these dies 18", 45" are closed, instead of the internal threads 26*a* or the plural grooves 26*a*' . . . 26*a*'.

Besides, in this third embodiment, an outer surface of each engaging member 26" and an inner surface of the front portion of the housing 16" are formed conical surfaces 26*c*", 16*a*", instead of the stepped surfaces, respectively, both of which incline continuously inwards as backwards with respect to the die housing 16". In addition, portions of the flanges 18*c*", 45*c*" to be clamped by the recesses 26*a*" . . . 26*a*" and portions of the recesses 26*a*" . . . 26*a*" to clamp the flanges 18*c*", 45*c*" are formed tapered faces 18*d*", 45*d*", 26*b*" . . . 26*b*", respectively.

Figure 16:
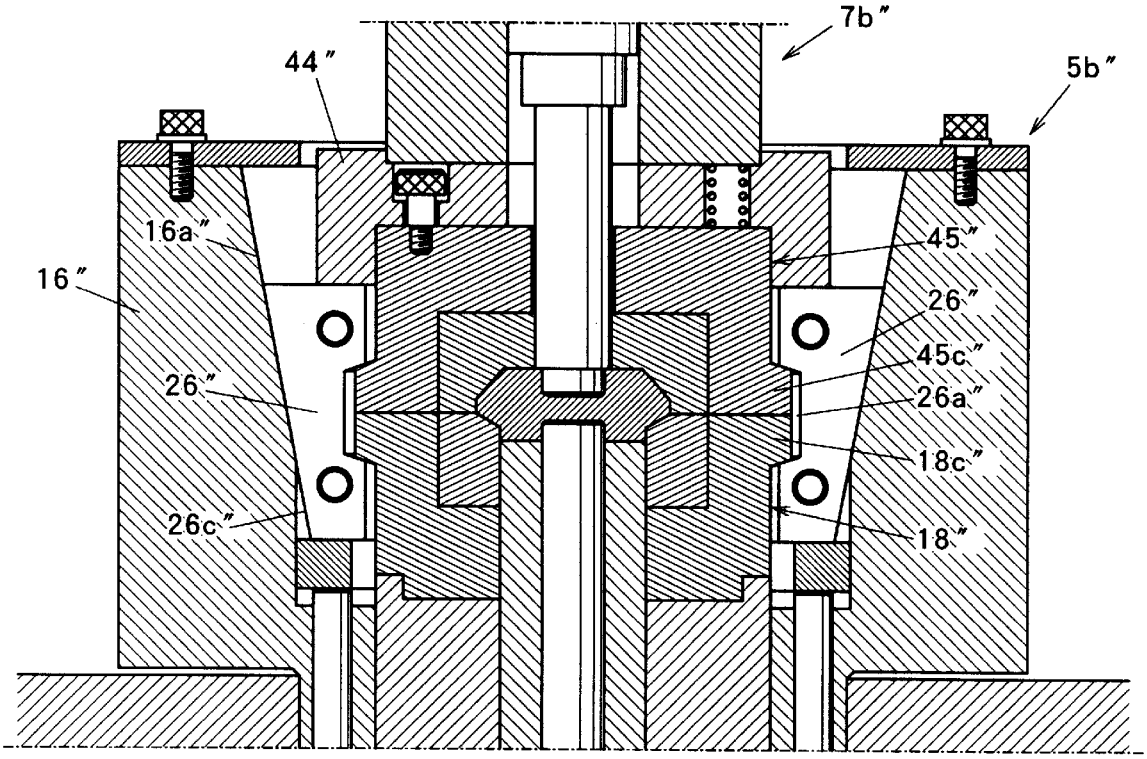

Thus, as shown in FIG. 16, the further a movable die unit 7*b*" moves forwards and a spacer 44" thrusts the engaging members 26" . . . 26" into the inside of the die housing 16", the smaller a diameter of a quaternion of the engaging members 26" . . . 26" due to cooperative guidance of both conical surfaces 26*c*", 16*a*" of the engaging members 26" . . . 26" and the die housing 16", and the stronger a clamping force toward the pair of dies 18", 45", which can realize a tighter closing of the dies 18", 45" and more hardly gives birth to flash.

Figure 17:
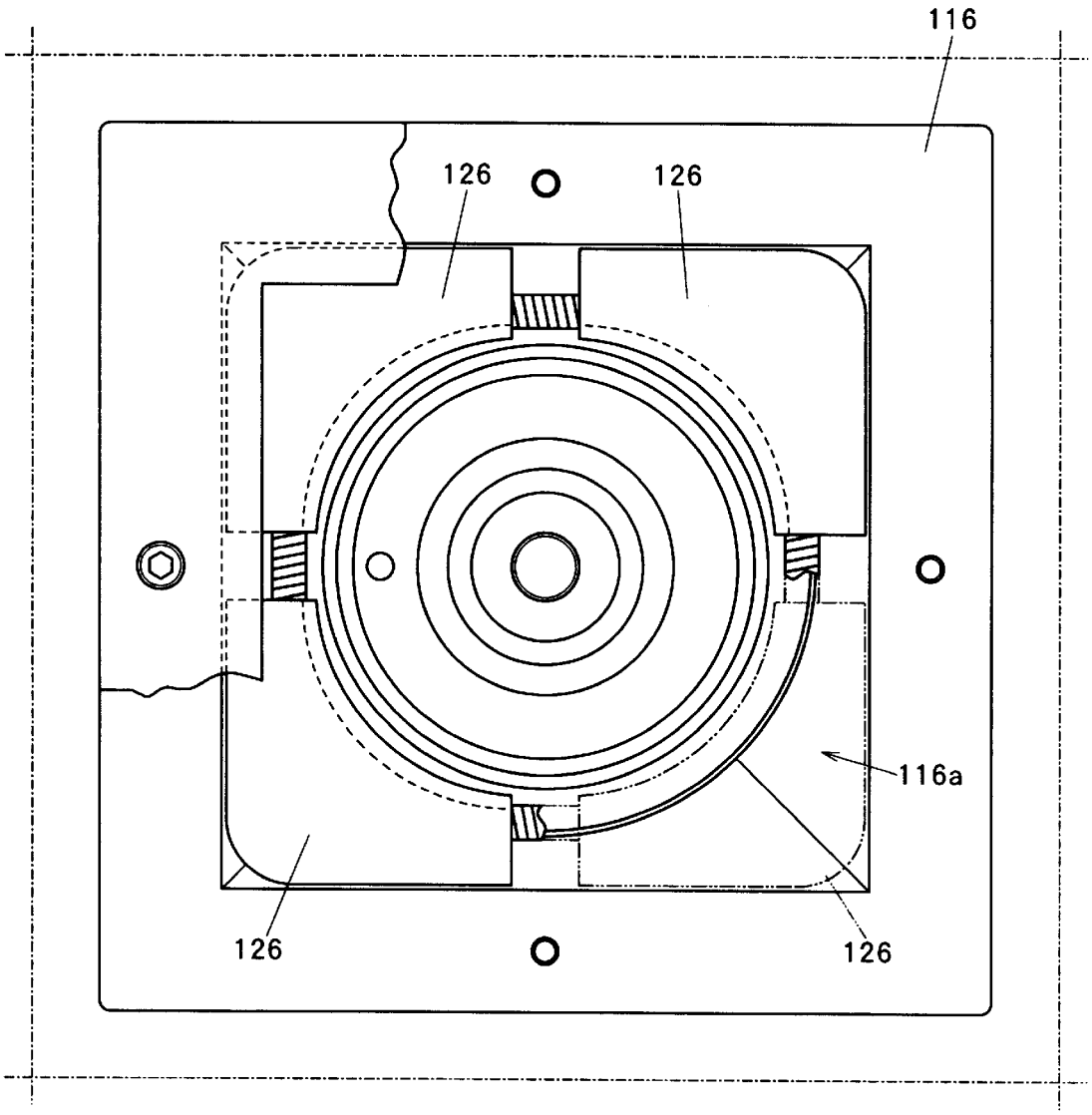
FIG. 17 is an elevational view, similar to FIG. 8, showing the fourth embodiment of the invention.

FIG. 17 shows a still another embodiment of the invention, in which a front portion of the die housing 116 is cubic-shaped and its inner surface 116*a* is formed pyramidal, each of four flat sidewalls inclining continuously inwards as backwards with respect to the die housing 116, instead of the conical surface 16*a*". Besides, each of the four engaging members 126 . . . 126 is like a longitudinally quartered piece of a pyramidal tubular member so as to have two tapered flat outer faces containing a corner, instead of the convexly curved surface.

This fourth embodiment brings about the preferable result that each engaging member 126 is always positioned properly at a corner of the pyramidal inner surface 116*a* of the die housing 116 during the forging operation and the engaging members 126 . . . 126 do not rotate relative to the die, which can do without pin 33 and cut-out 32*a* provided in the first embodiment.

Although the invention has been described in its preferred forms with a certain degree of particularity, it is understood that the present disclosure of the preferred forms have been changed in the details of construction and the combination and arrangement of parts may be resorted to without departing from the spirit and the scope of the invention as hereinafter claimed.

Having thus described the invention, it is claimed:

1. An apparatus for full enclosed die forging provided with a pair of dies, a stationary die in a die housing and a movable die movable toward and away from said stationary die in a forging direction, and at least one punch to plunge into a work in the closed pair of dies, the apparatus comprising:

the stationary die being mounted in the die housing to move in said forging direction into an inside of the die housing as the closed pair of dies move in said forging direction into the inside of the die housing;

annular engaging element in the die housing surrounding an area said stationary die is placed and being movable in said forging direction and shrinkable toward said area;

thrusting means for thrusting said annular engaging element in the forging direction into the inside of the die housing as the closed pair of dies move in said forging direction into the die housing; and shrinking means for shrinking said annular engaging element toward and into engagement with both of said closed pair of dies during an initial portion of said annular engaging element travel into the die housing and to maintain engagement of said annular engaging element with both of the closed dies without shrinking during a subsequent portion of travel into the die housing, the shrinking means and the annular engaging element move relative to each other during the initial and subsequent portions of travel into the die housing.

2. The apparatus according to claim 1, wherein the pair of dies have threads on their outer faces, and the annular engaging element has thread on its inner face capable for engaging with threads of the pair of dies.

3. The apparatus according to claim 1, further comprising flipping means for giving an impact to the annular engaging element so as to help said annular engaging element to be released from the closed pair of dies.

4. The apparatus according to claim 1, wherein:

the annular engaging element includes a first surface parallel to the forging direction and a second surface transverse to the forging direction;

the shrinking means includes third surfaces parallel to the forging direction and a fourth surface transverse to the forging direction; and said second surface moves along said fourth surface to shrink and said first surface moves along said third surface without shrinking.

5. The apparatus according to claim 4 wherein:

annular engaging element includes a fifth surface parallel to the forging direction and displaced from the first surface along and transverse to the forging direction;

the shrinking means includes a sixth surface parallel to the forging direction and displaced from the third surface along and transverse to the forging direction; and the fifth surface moves along the sixth surface without shrinking.

6. The apparatus according to claim 5 wherein:

the annular engaging element includes a seventh surface transverse to the forging direction and displaced from the second surface along and transverse to the forging direction;

the shrinking means includes an eighth surface transverse to the forging direction and displaced from the fourth surface along and transverse to the forging direction; and the seventh surface moves along the eight surface during shrinking.

7. The apparatus according to claim 4, wherein:

the annular engaging element includes a seventh surface transverse to the forging direction and displaced from the second surface along and transverse to the forging direction;

the shrinking means includes an eighth surface transverse to the forging direction and displaced from the fourth surface along and transverse to the forging direction; and the seventh surface moves along the eight surface during shrinking.

8. An apparatus for full enclosed die forging provided with a pair of dies, a stationary die in a die housing and a movable die movable toward and away from said stationary die in a forging direction, and at least one punch to plunge into a work in the closed pair of dies, the apparatus comprising:

the stationary die being mounted in the die housing to move in said forging direction into an inside of the die housing as the closed pair of dies move in said forging direction into the inside of the die housing;

annular engaging element in the die housing surrounding an area said stationary die is placed and being movable in said forging direction and shrinkable toward said area, the annular engaging element including a first surface parallel to the forging direction and a second surface transverse to the forging direction;

thrusting means for thrusting said annular engaging element in the forging direction into the inside of the die housing as the closed pair of dies move in said forging direction into the die housing; and shrinking means including third surfaces parallel to the forging direction and a fourth surface transverse to the forging direction, said second surface moves along said fourth surface to shrink said annular engaging element toward and into engagement with both of said closed pair of dies during an initial portion of said annular engaging element travel into the die housing, and said first surface moves along said third surface to maintain engagement of said annular engaging element with both of the closed dies without shrinking during a subsequent portion of travel into the die housing.

* * * * *